United States Patent [19]

Varin

[11] Patent Number: 4,564,972

[45] Date of Patent: Jan. 21, 1986

[54] ROLLER OR SKID TYPE VACUUM CLEANER NOZZLE ATTACHMENT

[75] Inventor: Michel Varin, Crepy-en-Valois, France

[73] Assignee: Etablissements Georges Olivier, Paris, France

[21] Appl. No.: 610,398

[22] Filed: May 15, 1984

[30] Foreign Application Priority Data

May 17, 1983 [FR] France ..... 83 08156

[51] Int. Cl.[4] ..... A47L 9/06

[52] U.S. Cl. ..... 15/359; 15/415 R

[58] Field of Search ..... 15/354, 355, 361, 359, 15/415 R

[56] References Cited

U.S. PATENT DOCUMENTS

| | | | |
|---|---|---|---|
| 993,202 | 5/1911 | Russell et al. | 15/359 X |
| 4,180,887 | 1/1980 | Wudel et al. | 15/359 X |
| 4,336,628 | 6/1982 | Bradshaw et al. | 15/415 R |

FOREIGN PATENT DOCUMENTS

| | | | |
|---|---|---|---|
| 2806260 | 8/1979 | Fed. Rep. of Germany | 15/359 |
| 2421313 | 11/1979 | France | 15/354 |
| 341964 | 12/1959 | Switzerland | 15/354 |
| 1138650 | 1/1969 | United Kingdom | 15/354 |

*Primary Examiner*—Chris K. Moore

*Attorney, Agent, or Firm*—Shenier & O'Connor

[57] ABSTRACT

This nozzle attachment consists of a casing containing a fixed sole and a moving plate supporting a brush, a rocking nozzle pivotably mounted about a shaft in the casing, the internal conduit whereof opens onto a center duct in contact with said sole, a sleeve wherein is rotatably fitted a suction tube and which is pivotably supported by said rocking nozzle, the internal conduits of said sleeve and said tube being connected in an airtight manner with the conduit of said nozzle, and a floor bearing roller mounted in a freewheeling manner about a shaft supported by said rocking nozzle at the back of said casing.

In accordance with the invention, said sleeve is pivotably mounted on said rocking nozzle about a shaft located between the nozzle's swiveling axis with respect to the casing and the centerline of the floor-contacting surface of the floor bearing part.

11 Claims, 5 Drawing Figures

ROLLER OR SKID TYPE VACUUM CLEANER NOZZLE ATTACHMENT

This invention relates to improvements made to a roller or skid type vacuum cleaner nozzle.

A nozzle of this type in the prior art consists of the following parts:

- a casing comprising a fixed sole having at least one suction opening and a moving brush-holding plate;
- a rocking nozzle pivotably mounted about a shaft in the casing, such that said nozzle's internal conduit opens onto a center duct terminating at the sole and embracing the suction opening or openings in the latter;
- a sleeve wherein is rotatably fitted a suction tube and which is pivotably supported by the rocking nozzle, the internal conduits of said sleeve and said tube being connected in an airtight manner with the conduit of said nozzle;
- and a floor bearing roller mounted in a free-wheeling manner about a shaft supported by the rocking nozzle at the rear of the casing.

In this well-known design, the same shaft serves as the rotational shaft for the roller and as the axis of pivoting by the sleeve on the rocking nozzle.

Consequently, the vacuum cleaner nozzle casing "hovers" and is unaffected by the pressure exerted by the user on the handle wand in manueuvering the floor attachment forward, backward, under furniture, along a skirting board and so on, and the pressure applied by the user merely serves to apply the roller to the floor. This feature is necessary due to the fact that vacuum cleaners are being made more and more powerful. However, the casing does not always apply evenly to the floor due to the inherently variable resistance of the floor to the sole's suction force as well as to brushing by the projecting brush. In light of these considerations, the above maneuvers are not as easily performed as the manufacturer had intended in selecting said hovering or floating design.

It is the object of the present invention to obviate this drawback by enhancing the vacuum cleaner nozzle's responsivity to handling such that the user, in maneuvering the handle wand, will be able to not only apply the roller to the floor, but also control the orientation of the nozzle according to external demands, whilst keeping the advantages of floating operation.

Accordingly, the invention provides a vacuum cleaner nozzle wherein the sleeve is pivotably fitted to the rocking nozzle about a shaft located between the pivot axis of said nozzle about the casing and the centerline of the floor-contacting area of the bearing part, said latter part being either a roller as previously mentioned or a skid.

Indeed, in view of advancing over any type of floor, the casing's bearing part may be either a roller, enclosed in the rocking nozzle and idle-mounted or "freewheeling" about a shaft through said nozzle, or a pair of rollers mounted at either side of the rocking nozzle on a shaft also supported by said nozzle.

On the other hand, to move over a fabric floor such as a carpet or rug or similar covering, the bearing part can be a skid. Said skid may have a convex contact surface and preferably be mounted in the rocking nozzle, or may have a substantially flat contact surface prolonging the sole and preferably be swivel-mounted in the rocking nozzle, between stops within said nozzle and on a shaft supported by said nozzle.

In a preferred embodiment of the invention, the joint about which the rocking nozzle rocks in relation to the casing is located above the plane defined by the same nozzle's swivel axis and the centerline of the floor contact area of the bearing part.

Obviously however, this articulation joint can be lowered to any level as long as the desired effect is obtained.

Moreover, an interlock can be arranged between the rocking nozzle and the casing to prevent the front of the casing from rising off the floor when the nozzle assembly or vacuum cleaner attachement as a whole is drawn backwards over a carpet with the brush extended.

Similarly, a preferably resilient stop can be inserted between the casing and the rocking nozzle, behind their swivel joint, to prevent the brush, when extended, from tipping forward.

The above-mentioned features, besides satisfying the main object of the invention, also provide several other advantages.

Thus, dust and other matter sucked through the nozzle which might with time gum up the joints and swivels of the rocking nozzle in the casing can be dislodged by the user on a practically continuous basis merely by working the handle wand and actuating the swivel.

In addition, the increased responsiveness of the attachment slightly reduces the slidability of the sole, prompting the operator to exert a force, which albeit very mild, nevertheless involves a sensitory feedback conveying the feeling of a job well done.

Various embodiments of the invention will now be described, which should not be construed as limiting the scope of the invention, with reference to the appended drawings in which.

Figure 1:
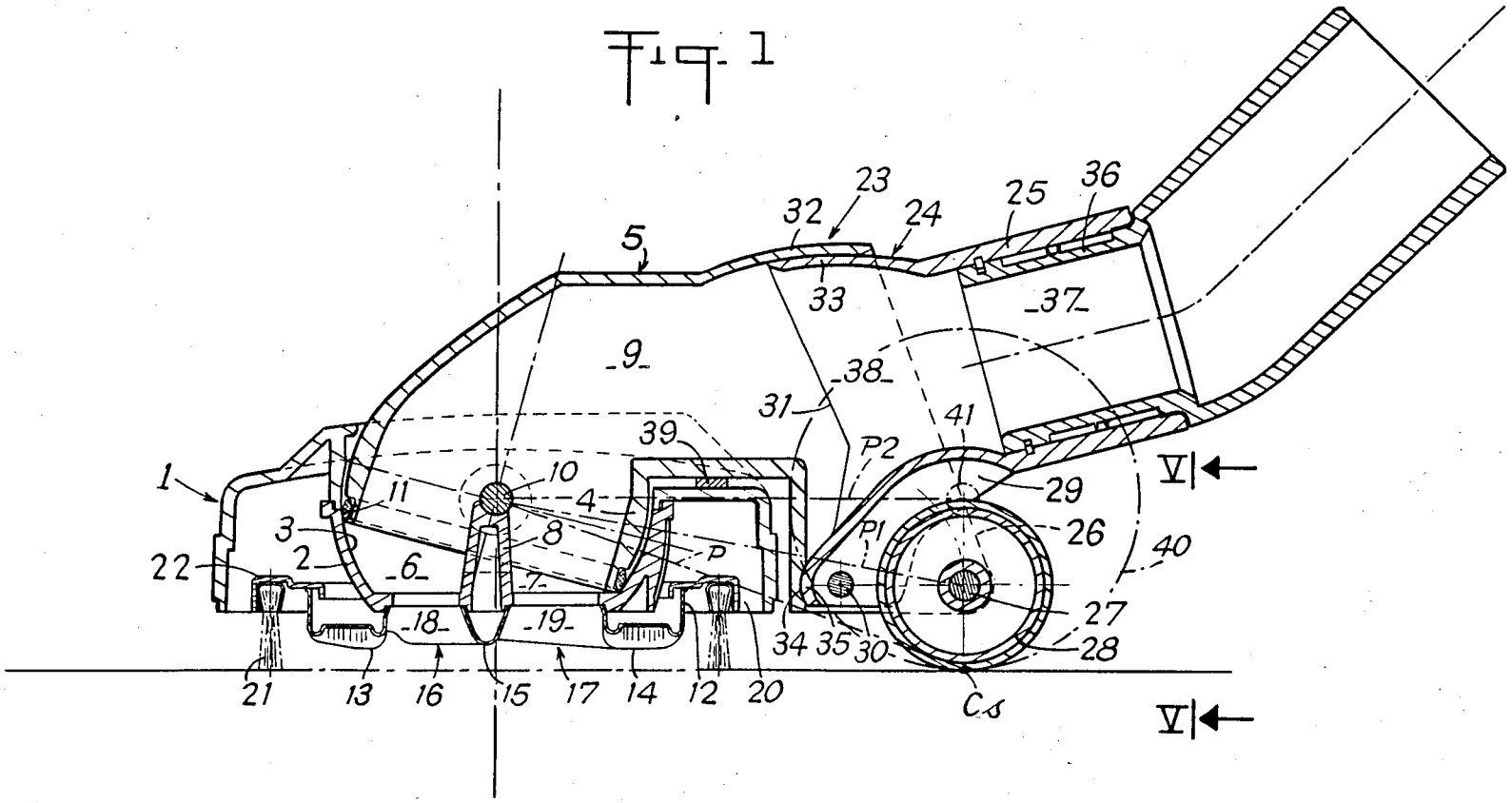
FIG. 1 is a cross sectional view going from front to back of a first embodiment of the nozzle attachment according to the invention.

The following features are common to all of the embodiments of the invention: a nozzle comprising a casing 1 of molded plastic; a duct 2 inserted into said casing and providing a spherically curved inside bearing 3 for a hollow swivel joint 4 of a rocking nozzle 5, also made of molded plastic; said duct separating into two branches 6 and 7 separated by a center partition 8 and communicating with an internal conduit 9 of said nozzle 5, said partition 8 constituting a bearing for a shaft 10 about which said nozzle swivels the swivel joint whereof 4 is fitted with a seal 11 applied to the spherical bearing 3 of duct 2.

A metal sole 12 with rounded edges 13, 14 is attached beneath the casing to provide a bearing on the floor; said edges, together with a third, less protruding intermediate rib 15, define two longitudinal suction channels 16, 17 feeding, via openings 18,19 into flues 6 and 7. An end slot 20 is provided between the casing 1 and the sole 12 for a brush 21 fitted to a movable plate 22, said plate being retractable by means of springs not specifically depicted in the figure, which thrust against the sole, or being thrust forward to push out the brush by means of cams, also left out of the drawing, actuated by at least one foot pedal or pushbutton.

Referring now to FIG. 1 and the first embodiment of the invention, nozzle 5, at its free extremity, is provided with a mouth 23 for the forced insertion of a pivotably, airtight-fitted mating end 24 of a sleeve 25, also made of molded plastic; to this end, the mouth 23 is provided with two side pieces 26 joined by a shaft 27 about which is mounted a free-wheeling, floor-bearing roller 28 and mating part 24 of the sleeve 25 has two outwardly bulging flanges 29 extending from said side pieces to said roller, without contacting said shaft 27 when said part 24 is swiveled down. In order to swivel, said side pieces 26 and flanges 29 are pierced by a swiveling shaft 30 located between said previously-mentioned shafts 10 and 27 near the plane P defined by shaft 10 and the roller 28 to floor contact generatrix Cs. Airtightness of swiveling is assured between the mouth 23 and its mating part 24 on the sleeve by contact between their flat side walls 26 and 31, their top walls 32 and 33, concentrically arching about shaft 30, and their lower rear walls 34 and 35, similarly arched about shaft 30.

An elbow tube, also of molded plastic, 36, for inserting a suction wand also serving as a handle, is rotatably fitted in said sleeve 25 and translationally fixed therein such as to cooperate with the rocking nozzle 5 in swiveling about shaft 30. Obviously, the internal conduits 37 of the tube, 38 of the sleeve and 9 of the nozzle are in permanent communication to allow air to flow continuously therethrough.

As a result of the special arrangement of shafts 10, 30 and 27 relative to one another, the operator, by maneuvering the handle wand can apply the roller 28 to the floor while at the same time finessing the pressure applied by the sole 12 and/or the brush 21 to the floor, by imparting to the nozzle 5, via swivel 30, a controllable moment of pivoting about shaft 27, either upwardly to relieve, or downwardly to increase pressure, casing 1 nevertheless remaining free to swivel about shaft 10 of the nozzle.

Moreover, a preferably resilient stop 39 is inserted at the back, between the top of the casing 1 and the bottom of the nozzle 5, to enable the operator to prevent the front of brush 21 from tipping floorwards.

This particularly useful feature applies regardless of whether a relatively small roller 28, entirely covered by the nozzle 5, is used, as depicted by the solid circle in FIG. 1, or relatively large rollers 40 are used to either side of said nozzle 5, as depicted by the hyphenated circle in FIG. 1. Planes P1 and P2, defined by shaft 10 of nozzle 5 and shaft 27 of the small roller 28 and shaft 41 of the large rollers 40 respectively, are higher than the previously mentioned plane P. However, the responsiveness of the attachment obtained thanks to the position of shaft 30 is substantially the same regardless of the diameter of the bearing roller, 28 or 40.

Figure 2:
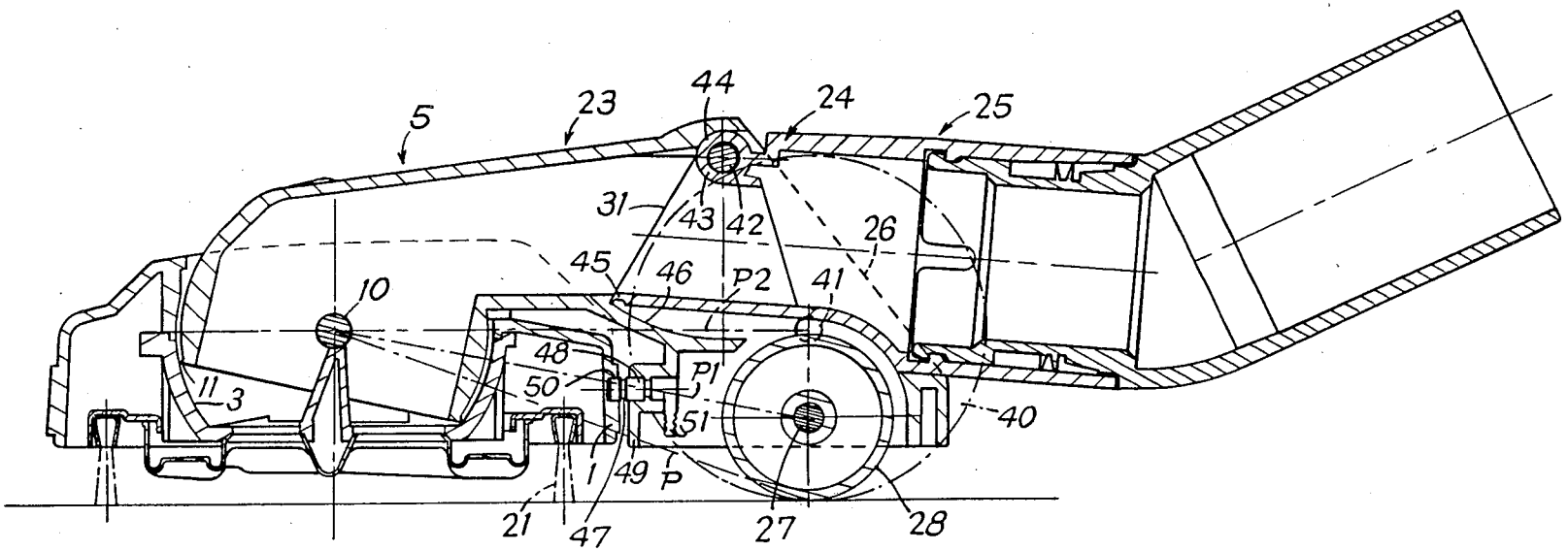
FIG. 2 is a similar view of a second embodiment of the invention.

In order to improve the responsiveness of nozzle motions to actions on the handle wand and to boost vacuuming efficiency, the second embodiment of the invention, illustrated in FIG. 2, provides a higher swivel joint for rocking nozzle 5 relative to sleeve 25. In this design, the shaft of a swivel joint 42 passes through the mating parts 23 and 24 of nozzle 5 and sleeve 25. Said shaft 42, as before, is still located between the other shafts 10 and 27 or 41, but is now above plane P.

In the example shown, shaft 42 is placed quite close to the top of the rocking nozzle and tightness during swiveling is ensured by contact between mouths 23 and 24 as in the previous embodiment, along flat side walls 26 and 31, along an upper cylindrical sleeve 43 of sleeve 25 surrounding the shaft 42 and cooperating with a partial mating recess 44 in rocking nozzle 5, as well as along a lower lip 45 of sleeve 25, said latter lip applying against a partial cylindrical bearing or journal 46 of said nozzle 5.

When the vacuum cleaner nozzle attachment is drawn back, with the brush applied to the carpet, the front of the casing tends to rise up off the floor, causing inefficient suction. It must therefore be possible to obviate this tendency on backup only and only if the operator so desires. This requirement can be met by including a manually controlled locking device 47 between the rocking nozzle and the casing 1.

In the embodiment depicted in FIG. 2, said lock is provided in the form of a rod 48 which is translationally guided in an underlying wall 49 of nozzle 5. The chamfered free end of said rod is designed to penetrate, for locking purposes, into a hole 50 in the casing 1 when the rod is pushed in by means of a lever 51 provided on the opposite end.

In both embodiments, whether as depicted in FIG. 1 or in FIG. 2, the rocking nozzle 5 rests on the floor via at least one roller 28 or 40. This roller accommodates utilization of the nozzle attachment on any type of floor.

Figure 5:
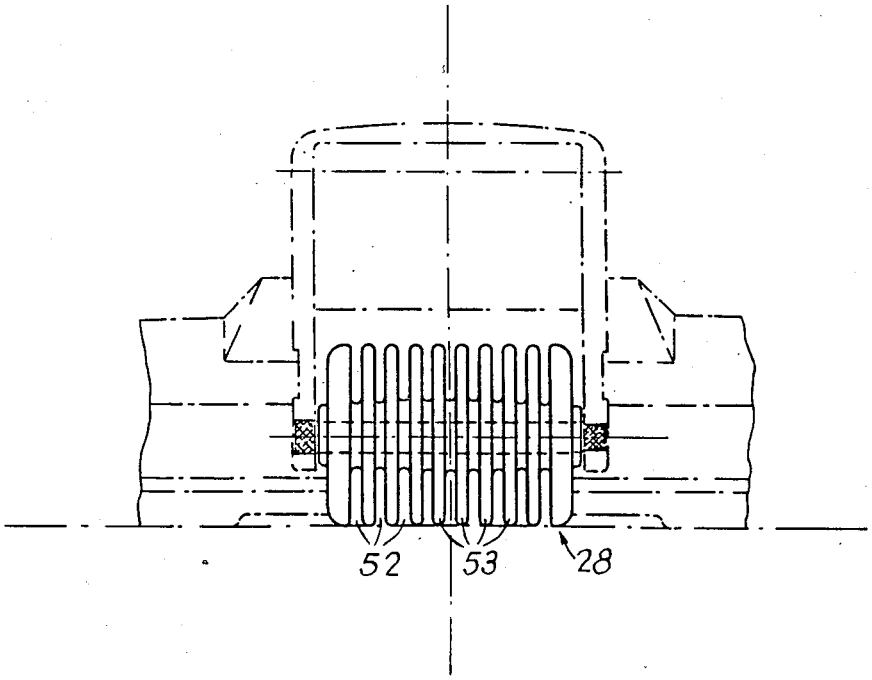
FIG. 5 is an end elevation of a particular embodiment of the roller, taken along V—V of FIG. 1.

Nevertheless, when working on a hard floor such as a wooden floor or tile floor, the smooth roller or rollers could become abrasive on running over sand or other solid matter being vacuum cleaned. In other words, they might scratch the floor surface. To avoid this, the roller or rollers 28 or 40 are constructed with voids 52 separating their bearing or running surfaces 53, as shown in FIG. 5. Accordingly, any grains of sand encountered by the rollers will move towards the voids 52 and thus be neither crushed nor dragged along by the running surfaces 53.

If the vacuum cleaner attachment is used mainly on a fabric floor such as a carpet or rug, it is best to replace the roller or rollers by a sliding skid 54 (FIG. 3) or 55 (FIG. 4) extending substantially in the same plane as the sole 12. The reference plane P mentioned previously herein by way of locating the swivel joint 30 or 42 is then defined by the swivel shaft 10 of the rocking nozzle 5 with respect to the casing 1 and the centerline Cs of the floor contact surface S or S'.

Figure 3:
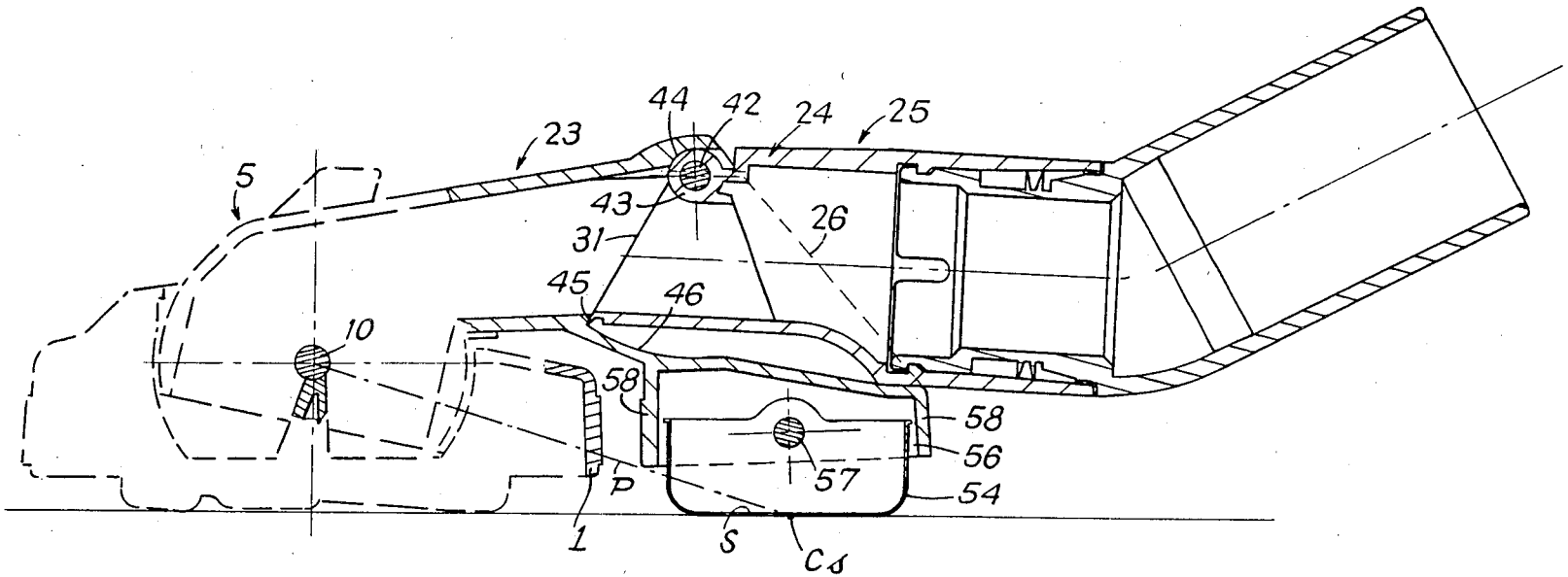
FIGS. 3 and 4 are partial illustrations of the same view as FIG. 2 emphasizing two alternative forms of floor bearing parts.

In accordance with the embodiment depicted in FIG. 3, the skid 54 has a substantially flat surface of contact S with the floor; it is mounted with a degree of play in a compartment 56 of nozzle 5 such that it can swivel about a shaft 57 within the limits imposed by the arresting walls 58 of said compartment. The shaft 57 of said swiveling skid can be the same shaft as that 27 of the roller 28 in the other embodiments.

Figure 4:
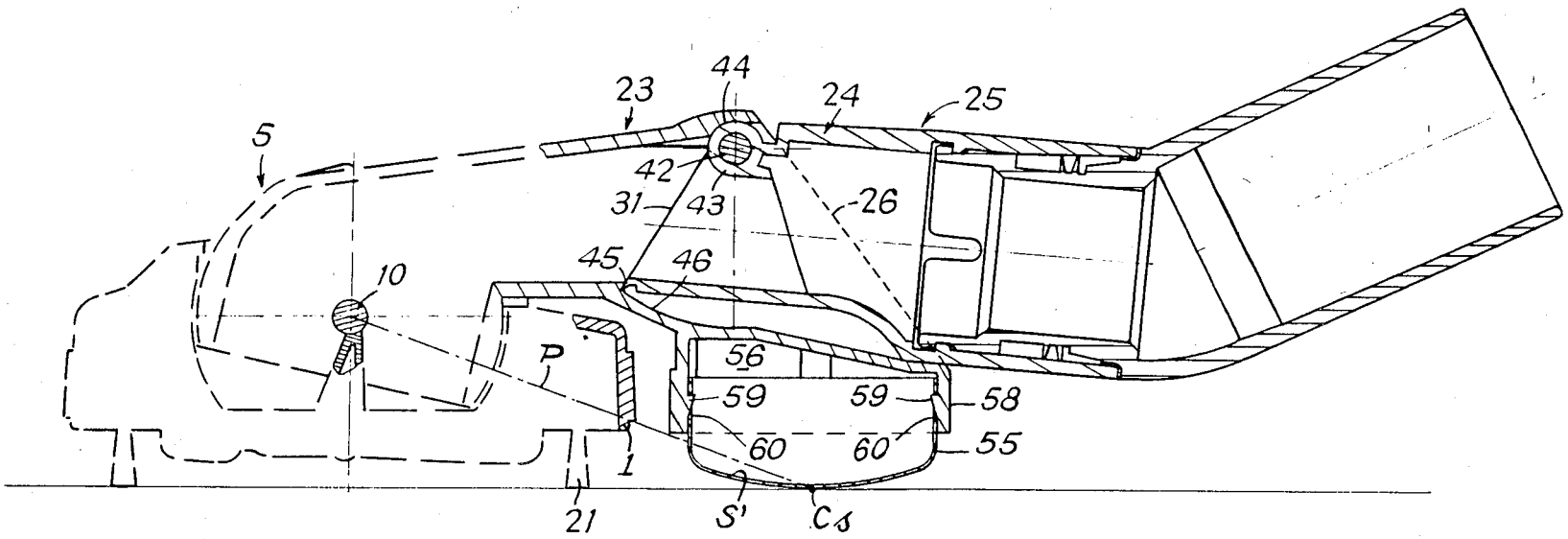

In a still further embodiment, depicted in FIG. 4, the skid 55 is stationary and its surface of contact with the ground S' is convex. This skid fits snugly into the previously-mentioned compartment 56 of nozzle 5 and can be secured in place by means of tabs 59 projecting from the inside wall 58 of compartment 56 and cooperating with openings 60 provided in the skid wall.

What is claimed is:

1. A vacuum cleaner nozzle attachment comprising a casing containing a fixed sole having at least one suction opening and a moving, brush-holding plate, a rocking nozzle pivotably mounted abut a shaft in the casing such that said nozzle's internal conduit opens onto a center duct terminating at the sole and embracing the suction opening or openings in the latter, a sleeve wherein is rotatably fitted a suction tube and which is pivotably supported by the rocking nozzle, the internal conduits of said sleeve and said tube being connected in an air-tight manner with the conduit of said nozzle, and a floor bearing part supported by the rocking nozzle at the rear of the casing, wherein said sleeve is pivotably fitted to the rocking nozzle about a shaft located between the pivot axis of said nozzle about the casing and the center line of the floor-contacting surface of the bearing part.

2. A vacuum cleaner nozzle attachment as in claim 1, wherein the swivel joint of the rocking nozzle with respect to the casing is located near the plane defined by the swiveling axis of said nozzle and the centerline of the floor-contacting surface of the bearing part.

3. A vacuum cleaner nozzle attachment as in claim 1, wherein the swivel joint of the rocking nozzle with respect to the casing is located above the plane defined by the swiveling axis of said nozzle and the centerline of the floor-contacting surface of the bearing part.

4. An attachment as in claim 1, wherein the mouths of the nozzle and the sleeve, respectively, are pivotably mated one inside the other such that airtightness of the pivot joint is ensured by contact between the flat side walls, the top walls concentrically arching about said swivel joint and the lower rear walls, the lower rear walls also arching about said swivel joint of said mating parts.

5. An attachment as in claim 1, wherein the floor bearing part is a roller, entirely covered by the rocking nozzle and idle-mounted about a shaft supported by said nozzle.

6. An attachment as in claim 1, wherein the floor bearing part consists of a pair of rollers mounted at either side of the rocking nozzle on a shaft also supported by said nozzle.

7. An attachment as in claim 1, having a roller or pair of rollers as floor bearing part, wherein said roller or rollers are provided with voids separating the actual bearing or running surfaces such that they may run over, without treading upon, any grains of sand or other solid particles which may be found on the floor.

8. An attachment as in claim 1, wherein the floor bearing part is a skid, preferably with a convex floor-contacting surface, attached inside the rocking nozzle.

9. An attachment as in claim 1, wherein the floor bearing part is a skid, preferably having a substantially flat floor-contacting surface prolonging the sole of the attachment, swivelably mounted in the rocking nozzle between arresting means in said nozzle and about a shaft supported by said nozzle.

10. An attachment as in claim 1, wherein an interlock is inserted between said rocking nozzle and said casing to prevent the front part of said casing from rising up off the floor as the nozzle is drawn backwards with its brush extended and applied to a carpet.

11. An attachment as in claim 1, wherein a stop, preferably resilient, is inserted between said casing and said rocking nozzle and behind their pivot axis to prevent said brush from tipping forward.

* * * * *